US010626873B2

(12) United States Patent
Hussain et al.

(10) Patent No.: US 10,626,873 B2
(45) Date of Patent: Apr. 21, 2020

(54) SYSTEM AND METHOD FOR DETERMINING A USE CONDITION FOR AN APPLIANCE

(71) Applicant: ConnectM Technology Solutions, Inc., Marlborough, MA (US)

(72) Inventors: Nayeem M. Hussain, Union City, NJ (US); Ryan T. Fant, New York, NY (US); William J. McLeod, Hoboken, NJ (US); Theodore R. Ullrich, New York, NY (US); Dean DiPietro, Brooklyn, NY (US); Nathan Gardner Meryash, New York, NY (US); Pepin Sebastian Gelardi, Brooklyn, NY (US)

(73) Assignee: CONNECTM TECHNOLOGY SOLUTIONS, INC., Marlborough, MA (US)

( * ) Notice: Subject to any disclaimer, the term of this patent is extended or adjusted under 35 U.S.C. 154(b) by 224 days.

(21) Appl. No.: 15/153,224

(22) Filed: May 12, 2016

(65) Prior Publication Data

US 2016/0333884 A1 Nov. 17, 2016

Related U.S. Application Data

(60) Provisional application No. 62/160,011, filed on May 12, 2015, provisional application No. 62/164,754, filed on May 21, 2015.

(51) Int. Cl.

| | |
|---|---|
| ***F04D 15/00*** | (2006.01) |
| ***F04D 15/02*** | (2006.01) |
| ***F04D 13/08*** | (2006.01) |

(52) U.S. Cl.
CPC ..... *F04D 15/0088* (2013.01); *F04D 13/086* (2013.01); *F04D 15/0236* (2013.01)

(58) Field of Classification Search
CPC ..... F04D 15/0245; F04D 15/0281; F04D 13/086; F04D 15/0236; F04D 15/0088
See application file for complete search history.

(56) References Cited

U.S. PATENT DOCUMENTS

2007/0286737 A1* 12/2007 Johnson ..... F04B 51/00 417/36
2011/0077875 A1* 3/2011 Tran ..... E03F 5/22 702/45
2014/0201315 A1* 7/2014 Jacob ..... H04L 12/2803 709/217
2014/0262134 A1* 9/2014 Arensmeier ..... F24F 11/02 165/11.2

(Continued)

*Primary Examiner* — Matthew G Marini
(74) *Attorney, Agent, or Firm* — Myers Wolin, LLC

(57) ABSTRACT

Systems and methods are provided for determining a use condition of an appliance, such as a sump pump, and outputting an indication of the current use condition of the appliance. A system implementing the method will first generate an actual first signature of a first characteristic associated with the appliance. The system will then generate an actual second signature of a second characteristic associated with the appliance. Each of the actual first and second signatures are then compared to corresponding expected signatures. The system then selects a current use condition from a plurality of use conditions based on the relationship between the actual signatures and the expected signatures.

16 Claims, 12 Drawing Sheets

(56) References Cited

U.S. PATENT DOCUMENTS

| | | | | |
|---|---|---|---|---|
| 2014/0266755 | A1* | 9/2014 | Arensmeier | F24F 11/0086<br>340/679 |
| 2015/0134125 | A1* | 5/2015 | Dedow | D06F 37/203<br>700/279 |
| 2015/0147190 | A1* | 5/2015 | Cummings | F04B 49/02<br>417/36 |

* cited by examiner

| Category of Failure Mode | Description of Failure Mode | Potential Effects of Failure | Severity | Potential component failure | Possible Causes of Failure | Goal of Applying Inventive Method | Potential implementation of Inventive Methods |
|---|---|---|---|---|---|---|---|
| Turned on primary sump pump does not discharge water from sump pit. | Pump successfully removes water from sump pit. Water in discharge pipe returns to sump pit when pump is turned off. Returned water may cause pump to turn on again. | Low-level flooding. Continuous pump operation and fatigue. | 5 | Check valve failure. | Fatigue exacerbated by corrosive pump fluid or crud in sump. Poor assembly, defective unit. | Check valve failure or declining health may be detected, and user is notified that check valve may need to be replaced. | Monitor pressure in sump pit to detect a pressure spike immediately after turning the pump off, which may indicate a faulty or damaged check valve. |
| | Pump draws varied amount of current. Possible increase in noise. Pump moves no water. | Continuous pump operation. Flooding. Potential risk of injury. | 6 | Electric motor failure. | Fatigue due to continuous running, age, humidity, or debris. Power switch circuit failure. | Motor or impeller failure or declining health may be detected, and user is notified of impending system failure. Suggested action item may be to replace the primary sump pump. | Benchmark and monitor current draw of sump pump during operation. A higher than normal current draw could indicate motor failure. The method should indicate declining health of sump pump, and/or suggest replacing the sump pump. Modlet may extend motor life by preventing idle power consumption. May also track time of pump operation as a measure of motor / pump health. |
| | Pump draws normal current. Possible increase in noise. Pump moves no water. | Continuous pump operation. Flooding. Potential risk of injury. | 6 | Impeller failure. | Age and debris. Faulty joint between impeller and motor. | | Benchmark and monitor rate of change of pressure of an operational sump pump. A higher than normal rate of change of pressure could indicate impeller failure. The method should indicate declining health of sump pump and/or suggest replacing sump pump. |
| | Water enters foundation or returns to sump pit. | Continuous pump operation. Flooding. Potential risk of injury. Mold growth in foundation. | 6 | Discharge pipe failure. | Loose connection or insufficient length of pipe. | Damaged discharge pipe will be detected, and the user will be notified that the discharge pipe may need to be replaced or repaired. | Benchmark exit flow rate (or rate of change of pressure) of a healthy sump pump and discharge pipe. A lower than normal exit flow rate or rate of change of pressure could indicate discharge pipe failure. |
| | Pump draws normal amount of current. Possible increase in noise. Pump moves no water. | Continuous pump operation. Flooding. Potential risk of injury. | 5 | Clogging / freezing in outdoor discharge pipe. | Freezing temperatures around discharge pipe. Debris. | Clogging / freezing in discharge pipe will be detected, and maintenance will be suggested. | Monitor temperature in discharge pipe, possibly relative to local frost line data. Anticipate when water in discharge pipe might freeze with weather forecast. Suggest maintenance at regular intervals as a preventative measure. |
| | Pump draws normal amount of current. Possible increase in noise. Pump moves no water. | Motor / impeller failure. Flooding. Potential risk of injury. | 5 | Clogging in indoor fluid paths. | Screen / filter damage. General debris / silt collection over time. | Clogging in indoor fluid path will be detected, and maintenance will be suggested. | Benchmark exit flow rate (or rate of change of pressure) of a healthy sump pump and discharge pipe. A lower than normal exit flow rate / rate of change of pressure could indicate obstructed impeller. Suggest maintenance at regular intervals as a preventative measure. |
| | Pump draws varied amount of current. Possible increase in noise. Pump moves no water. | Motor / impeller failure. Flooding. Potential risk of injury. | 5 | Obstructed impeller. | Screen / filter damage. General debris / silt collection over time. | Clogging in impeller will be detected, and maintenance will be suggested. | Benchmark exit flow rate (or rate of change of pressure) of a healthy sump pump and discharge pipe. A lower than normal exit flow rate / rate of change of pressure could indicate obstructed impeller. Suggest maintenance at regular intervals as a preventative measure. |

FIG. 5A

| Category of Failure Mode | Description of Failure Mode | Potential Effects of Failure | Severity | Potential component failure | Possible Causes of Failure | Goal of Applying Inventive Method | Potential implementation of Inventive Methods |
|---|---|---|---|---|---|---|---|
| Primary sump pump is powered, but does not turn on. | Pump does not respond to high water in sump pit. No current draw from pump. | Flooding / risk of injury. | 5 | Float switch | Debris/silt compromising mechanical function. Fatigue. | Faulty float switch will be detected. | Monitor water level (pressure) against current draw. No current being drawn at high water levels could indicate float switch failure. Suggest maintenance at regular intervals as a preventative measure. Track time of pump operation to define maintenance intervals. |
| | Pump does not respond to high water in sump pit. No current draw from pump. | Flooding / potential risk of injury. | 5 | Pressure sensor switch failure | Debris/silt compromising sensor function. Overheating from constant use. | Faulty pressure sensor will be detected. | Monitor water level (pressure) against current draw. No current being drawn at high water levels could indicate pressure sensor failure. Suggest maintenance at regular intervals as a preventative measure. Track time of pump operation to define maintenance intervals. |
| Primary sump pump is unpowered. | Pump is plugged in but does not draw current. | Flooding / potential risk of injury. | 5 | - | Power outage. | Detection and notification of blackout or local outlet failure. | Monitor current draw from outlet. Track outages in area through internet connection. |
| | | | | - | Outlet failure. | | |
| | | | 6 | Circuit failure | - | Detection and notification of internal power failure. | - |
| Turned on primary sump pump does not discharge water at an adequate rate. | Pump is operating well, but flooding still occurs. | Flooding / potential risk of injury. | 6 | - | Inadequate horsepower/GPH specification. | Detection and notification that sump pump is wrong size. | Detect whether water level is rising or falling while pump is operational. |
| | | | 7 | - | Extreme weather. | Detection and notification of inclement weather in forecast. | Track weather through internet connection. |
| Ground fault. | Wiring electrocutes user, and pump may not activate. | Flooding / potential risk of severe injury. | 10 | AC outlet | PSP plugged into non-GFCI outlet. | Prevent risk of electrocution. | Circuit breaker. |
| | | | | Wiring | Exposed / damaged wiring. | | |

FIG. 5B

| Category of Failure Mode | Description of Failure Mode | Potential Effects of Failure | Severity | Potential component failure | Possible Causes of Failure | Goal of Applying Inventive Method | Potential implementation of Inventive Methods |
|---|---|---|---|---|---|---|---|
| Turned on Backup Sump Pump (BSP) does not discharge water from sump pit. | Pump successfully removes water from sump pit. Water in discharge pipe returns to sump pit when pump is turned off. Returned water may cause pump to turn on again. | Flooding / potential risk of injury with no backup measure. | 8 | Check valve failure. | Fatigue exacerbated by corrosive pump fluid or crud in sump. Poor assembly, defective unit. | Check valve failure / declining health will be detected, and user will be notified that check valve may need to be replaced. | Monitor pressure in sump pit - a pressure spike immediately after turning the pump off can indicate a faulty or damaged check valve. |
| | Pump does not respond to high water in sump pit. No current draw from pump. | | | Float switch / pressure sensor switch failure. | Debris / silt. Float switch fatigue. Pressure sensor overheating. | Faulty float switch / pressure sensor will be detected. | Monitor water level (pressure) against battery consumption. No battery power being consumed at high water levels could indicate float switch failure. Suggest maintenance at regular intervals as a preventative measure. Track time of pump operation to define maintenance intervals. |
| | Pump draws varied amount of current. Possible increase in noise. Pump moves no water. | | | Electric motor failure. | Fatigue due to continuous running, age, humidity, debris. Power switch circuit failure. | Motor / impeller failure / declining health will be detected, and user will be notified of impending system failure. Suggested action item may be to replace the BSP. | Benchmark and monitor battery consumption rate of an operational sump pump. A higher than normal battery consumption rate could indicate motor or impeller failure. Indicate declining health of BSP, and / or suggest replacing BSP. Track time of BSP operation as measure of motor / impeller / pump health. |
| | Pump draws normal current. Possible increase in noise. Pump moves no water. | | | Impeller failure. | Age and debris. Faulty joint between impeller and motor. | | |
| | Water enters foundation or returns to sump pit. | | | Discharge pipe failure. | Loose connection or insufficient length of pipe. | Damaged discharge pipe will be detected, and the user will be notified that the discharge pipe may need to be replaced / repaired. | Benchmark exit flow rate (or rate of change of pressure) of a healthy BSP and discharge pipe. A lower than normal exit flow rate / rate of change of pressure could indicate discharge pipe failure. |
| | Pump draws normal amount of current. Possible increase in noise. Pump moves no water. | | | Clogging / freezing. | Screen / filter damage. General debris / silt collection over time. | Clogging / freezing will be detected, and maintenance will be suggested. | Benchmark exit flow rate (or rate of change of pressure) of a healthy sump pump and discharge pipe. A lower than normal exit flow rate / rate of change of pressure could indicate clogging / freezing. Suggest maintenance at regular intervals as a preventative measure. |

FIG. 6A

| Category of Failure Mode | Description of Failure Mode | Potential Effects of Failure | Severity | Potential component failure | Possible Causes of Failure | Goal of Applying Inventive Method | Potential implementation of Inventive Methods |
|---|---|---|---|---|---|---|---|
| Turned on BSP does not discharge water at an adequate rate. | Pump is operating well, but flooding still occurs. | Flooding / potential risk of injury with no backup measure | 8 | - | Inadequate horsepower / GPH specification. | Detection and notification that sump pump is wrong size. | Detect whether water level is rising or falling while pump is operational. |
| | | | 8 | - | Extreme weather. | Detection and notification of inclement weather in forecast | Track weather using internet. |
| BSP does not turn on. | Pump with functional float switch / pressure sensor switch does not turn on. | Flooding / potential risk of injury with no backup measure | 9 | Circuit failure. | - | Detection of internal power failure (battery life is good but BSP is not turning on). | - |
| | | | 8 | Faulty battery. | - | Detection of faulty battery. | Suggest test charging battery during installation. |
| BSP turns off while water levels are rising | - | Flooding / potential risk of injury with no backup measure | 7 | Dead battery. | Battery power consumed more quickly than battery can be charged. | Detection of near-dead battery and notify user before battery dies. | Monitor battery life. |
| | | | 8 | Faulty battery. | - | Detection of faulty battery. | Suggest test charging battery during installation. |
| BSP battery does not charge | - | Flooding / potential risk of injury with no backup measure | 7 | - | Power outage | Detection of power outage or local outlet failure | Monitor current draw from outlet. Track outages in area using internet. Monitor battery life and provide real-time updates. |
| | | | 7 | - | Outlet failure | | |
| | | | 8 | Circuit failure. | - | Detection of internal power failure (battery life is good but BSP is not turning on). | Suggest test charging battery during installation. |
| | | | 7 | Faulty battery. | - | Detection of faulty battery. | |

FIG. 6B

| COMPONENT CONCERN | WEATHER SYMPTOM | WATER LEVEL SYMPTOM | POWER SYMPTOM 1 | POWER SYMPTOM 2 | POWER SYMPTOM 3 | POWER SYMPTOM 4 |
|---|---|---|---|---|---|---|
| | | | **Duty Cycle** | **Frequency of Duty Cycles** | **Current Qualities** | **Other** |
| Severe Weather Warning | Local weather alert (freezing temp / rain forecast) | | | | | |
| Local Area Power Outage | Local severe weather alert | | | | | Modlet Offline |
| Discharge Pipe Clog / Check Valve Clog | | Reduced discharge rate | Longer duty cycle | | Reduced current draw | |
| Discharge Pipe Clogged from Freezing | Local freezing temp alert | Reduced discharge rate | Longer duty cycle | | Reduced current draw | |
| Abnormal Water Ingress | Local severe weather alert | Rapid water level increase immediately after duty cycle | Longer duty cycle | Elevated Frequency | | |
| Check Valve Doesn't Close | | Rapid water level increase immediately after duty cycle | | Elevated Frequency | | |
| Motor Wear | | | | | Elevated current draw | |
| Motor Shaft Wear / Impeller Wear | | Reduced discharge rate | | | | |
| Inhibited Impeller | | Reduced discharge rate | | | May eventually reach a low steady-state irregular current draw while running | |
| Discharge Pipe leaking near foundation | | | | Elevated Frequency | | |
| Inadequate Pump size | | | Longer duty cycle | | | |
| Switch doesn't turn on | | High water level | | | | No current draw |
| Switch doesn't turn off | | | | | Elevated current draw | Running for a long time without any duty cycles |
| Outlet Wiring Problem | | High water level | | | Elevated current draw | Modlet offline |
| GFCI Tripped | | | | | | Sumplet GFCI triggered |

FIG. 7

| Scenario | | Current Draw (A) | | | Notes |
|---|---|---|---|---|---|
| Condition | Description | Start | Steady State | Spike | |
| Dry | Sump pump operating out of water with no load applied. | 5.63 | 5.63 | | |
| Normal wet condition | Sump pump was operated in water with no silt or rocks. | 5.30 | - | - | |
| Extended wet condition | Sump pump was operated in water continuously for 30 minutes with no silt or debris. | 5.30 | ~5.03 | | |
| Discharge pipe clog | Sump pump was operated in water with discharge pipe clogged with a rag and silt. | 4.95 | 4.88 | | Noticeably low exit flow / long run time. Silt / water was circulated in section of discharge pipe before clog. |
| Silt in water | Silt was gradually poured into sump pit as sump pump operated. | - | 4.88 | 4.95 + 0.32<br>4.95 + 0.29<br>4.95 + 0.27 | Noticeable variation in exit flow. |
| Silt and rocks in water | 5 lbs of small rocks (~.25 inches in diameter) were gradually poured into silt and water mixture in sump pit as sump pump operated. | - | 4.88 | | Noticeably low exit flow / long run time. |

FIG. 8

SYSTEM AND METHOD FOR DETERMINING A USE CONDITION FOR AN APPLIANCE

CROSS REFERENCE TO RELATED APPLICATIONS

This application claims the benefit of U.S. Provisional Patent Application No. 62/160,011, filed May 12, 2015, and U.S. Provisional Patent Application No. 62/164,754, filed May 21, 2015, the contents of each of which are incorporated by reference herein in their entirety.

FIELD OF THE INVENTION

The invention relates to automatically determining a use condition for an appliance, specifically for monitoring a sump pump for actual or projected failure.

BACKGROUND

A wide variety of home appliances can fail without warning, and when they do, consumers are often left without suitable alternatives or contingency plans. For example, sump pumps are often the only line of defense for homeowners against flooding and are relied on to protect homes from tens of thousands of dollars in flood damage. Such pumps frequently fail without any perceivable warning, preventing homeowners from taking appropriate preventative action before failure.

In many homes with basements and high water tables, sump pumps are used to actively pump water out of the ground under the home or from the walls surrounding the home and push it to safe drainage systems. Sump pumps range in price from several hundred to several thousand dollars, and often owners buy two so as to have a backup. One reason that homeowners are so willing to pay excessive fees for pumps is that such pumps often fail and when they fail they typically do so without warning and catastrophically.

A malfunctioning sump pump can allow a basement to flood, costing tens of thousands of dollars, and such flooding is often not covered by standard flood insurance policies. There is a need for analytical systems and platforms that can provide insight into these product failures, potentially prevent such failures, and allow users to replace or repair systems (or remove system obstructions) before they fail.

Users of such a platform would enjoy peace of mind knowing that their pump was functioning correctly. Such a platform could further prevent catastrophic failures, extending the life of an average sump pump.

While some modern sump pumps can connect to the internet to alert users to a pump state, these platforms are expensive and cannot be retrofitted to existing sump pumps. They are also typically limited as to what states they can identify.

Homeowners familiar with the risk have to frequently check their sump pumps, install flood sensors, and maintain the system. For those with second homes, floods can occur at any time without visibility, limiting a homeowner's peace of mind. The willingness of such homeowners to purchase backup sump pumps, backup batteries, leak/flood water sensor alarms, and high end pump systems all offer an insight into the need for an inexpensive system and platform that can be retrofitted to an existing sump pump.

SUMMARY

The present disclosure is directed to systems and methods for determining a use condition of an appliance, such as a sump pump, and outputting an indication of the current use condition of the appliance.

Typically, a system implementing the method will first generate an actual first signature of a first characteristic associated with the appliance. The first characteristic is typically a record of fuel or power supplied to the appliance, and it may be, for example, a current supplied to the appliance. Accordingly, the first signature may be a current signature associated with the appliance. In some embodiments, information about the functioning of the appliance may be extracted just from the first signature, such as duty cycle, frequency, and current draw. In some cases, this may be enough to identify failure of the appliance.

The system further generates an actual second signature of a second characteristic associated with the appliance. The second characteristic may be a record of the functioning of the appliance. For example, where the appliance is a sump pump, the second characteristic may be the water level in a sump pit.

Each of the actual first and second signatures are then compared to expected values for the corresponding signatures, and a use condition is selected based on those comparisons. For example, if both signatures correspond well with the expected signatures for a sump pump functioning correctly, the use condition may be that the appliance is functioning correctly. The system then provides an indication that the appliance is in the current use condition. If the first and second signatures do not correspond well to expected signatures, the use condition may indicate abnormal operation. The use conditions may be, for example, normal, failure, and projected failure.

If the current use condition indicates abnormal operation, the first signature may be compared to additional expected first signatures representing different failure modes, such that if the actual first signature corresponds well to an expected signature for a known failure mode, the use condition may indicate that failure mode.

In some embodiments, expected signatures may be selected based on environmental factors, such as local weather, which may be determined using an internet connection. In some embodiments, expected signatures may be selected based on the model number of the appliance.

The method may be applied to both primary appliances and backup appliances, and where the primary appliance has failed, the method may then be applied to the backup appliance.

Results of applying the method may be recorded over time and stored in a database, and the average actual signatures over time may be used to determine an expected signature. In such embodiments, deviations from previous signatures may be used to predict failure of the appliance. This storage of information may be utilized in determining expected signatures for other local appliances based on geolocating those appliances.

A system implementing the method may include an electrical outlet for providing electric current to the appliance, a current measuring circuit for determining the current supplied to the appliance, a memory, a processor, and an alert module.

Typically, the memory records the current supplied to the appliance over time, and the processor generates an actual current signature from the current supplied in implementing the method.

BRIEF DESCRIPTION OF THE DRAWINGS

FIGS. 5A-B show a failure mode analysis for the primary pump;

FIGS. 6A-B show a failure mode analysis for the backup pump;

FIG. 7 shows a table of use conditions and corresponding indications of those use conditions;

FIG. 8 shows measurements of current flow that could be used to identify certain failure modes;

DETAILED DESCRIPTION OF THE PREFERRED EMBODIMENTS

Figure 1:
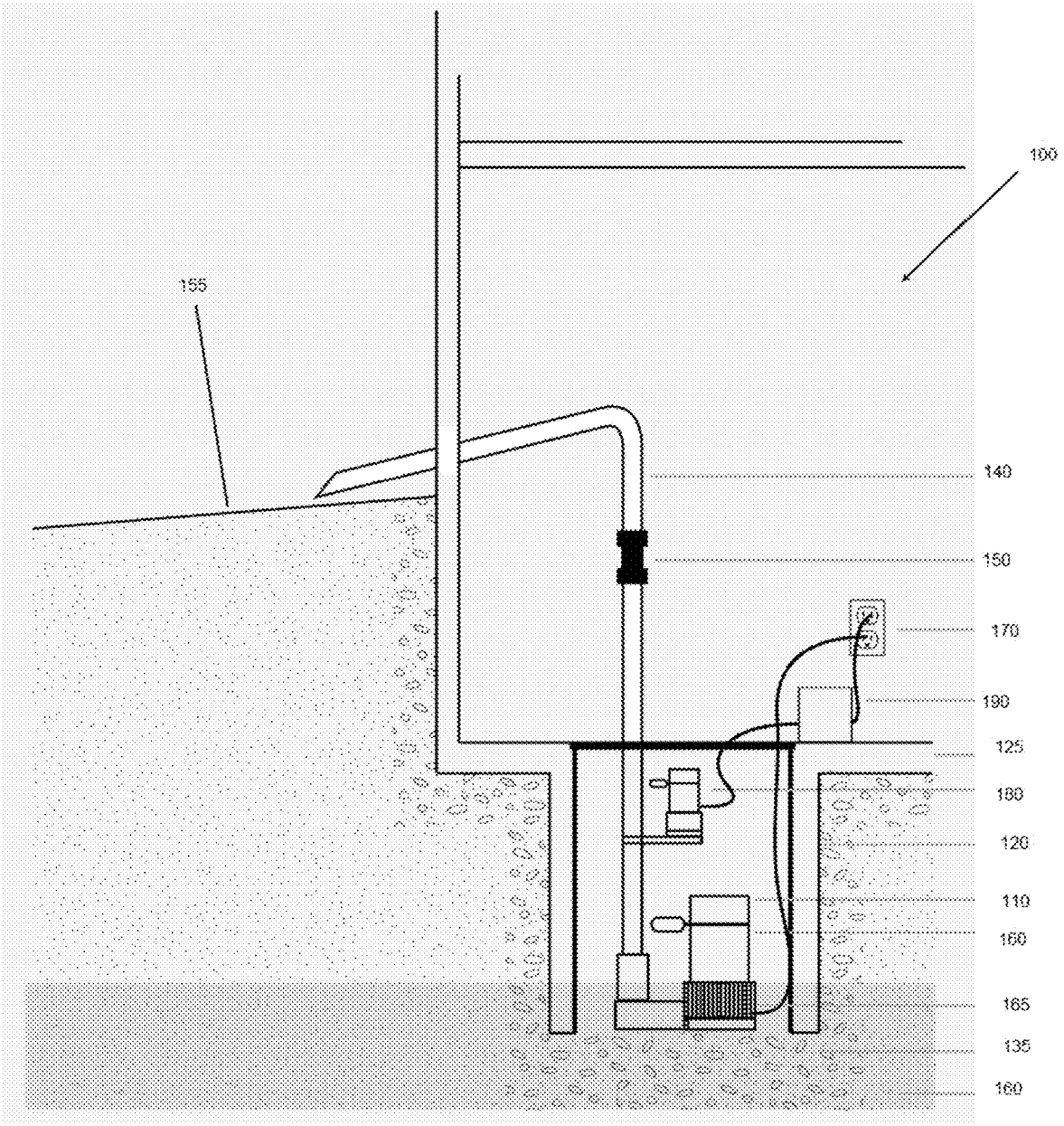
FIG. 1 (PRIOR ART)
FIG. 1 is an illustration of a typical sump pump installation.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

FIG. 1 shows a typical sump pump installation 100 as exists in the prior art. Typically, a primary sump pump 110 is installed in a sump pit 120 in the foundation of a building below a basement floor 125. The primary sump pump 110 is typically installed at the bottom of the sump pit 120 and pumps any water in the sump pit, such as ground water 130 that climbs into the sump pit through a layer of permeable gravel 135, through a discharge pipe 140 and outside of the building. To prevent the backflow of water into the sump pit 120 through the discharge pipe 140, the pipe is typically fitted with a check valve 150, and the ground outside the building 155 is typically sloped away from the wall of the building.

When the water level rises in sump pit 120, the pump is activated upon the activation of a switch 160. The switch 160 may be a float valve for activating an impeller 165 of the primary sump pump 110 any time the water level rises above an acceptable level. When the primary sump pump 110 functions properly, the water level would be kept within an acceptable range. The primary sump pump 110 is typically powered using an electrical outlet 170 in the basement of the building providing AC power.

Many installations further feature a backup sump pump 180 installed within the sump pit 120 above the level of the primary sump pump 110. Typically, the backup sump pump 180 is smaller and has a lower capacity than the primary sump pump 110 and provides pumping support when the water level rises above an acceptable level due to a failure of the primary sump pump 110 or particularly poor environmental conditions that exceed the capacity of the primary sump pump, such as flooding. The backup sump pump 180 may pump water through the same discharge pipe 140 used by the primary sump pump 110, and may be plugged into the electrical outlet 170 in the basement providing AC power as well. In addition to AC power, the backup sump pump 180 may be provided with a DC battery 190 to provide power in the event of a power failure. Accordingly, if the primary sump pump 110 fails to activate due to a power failure, the backup sump pump 180 may activate when the water level rises sufficiently.

Figure 2:
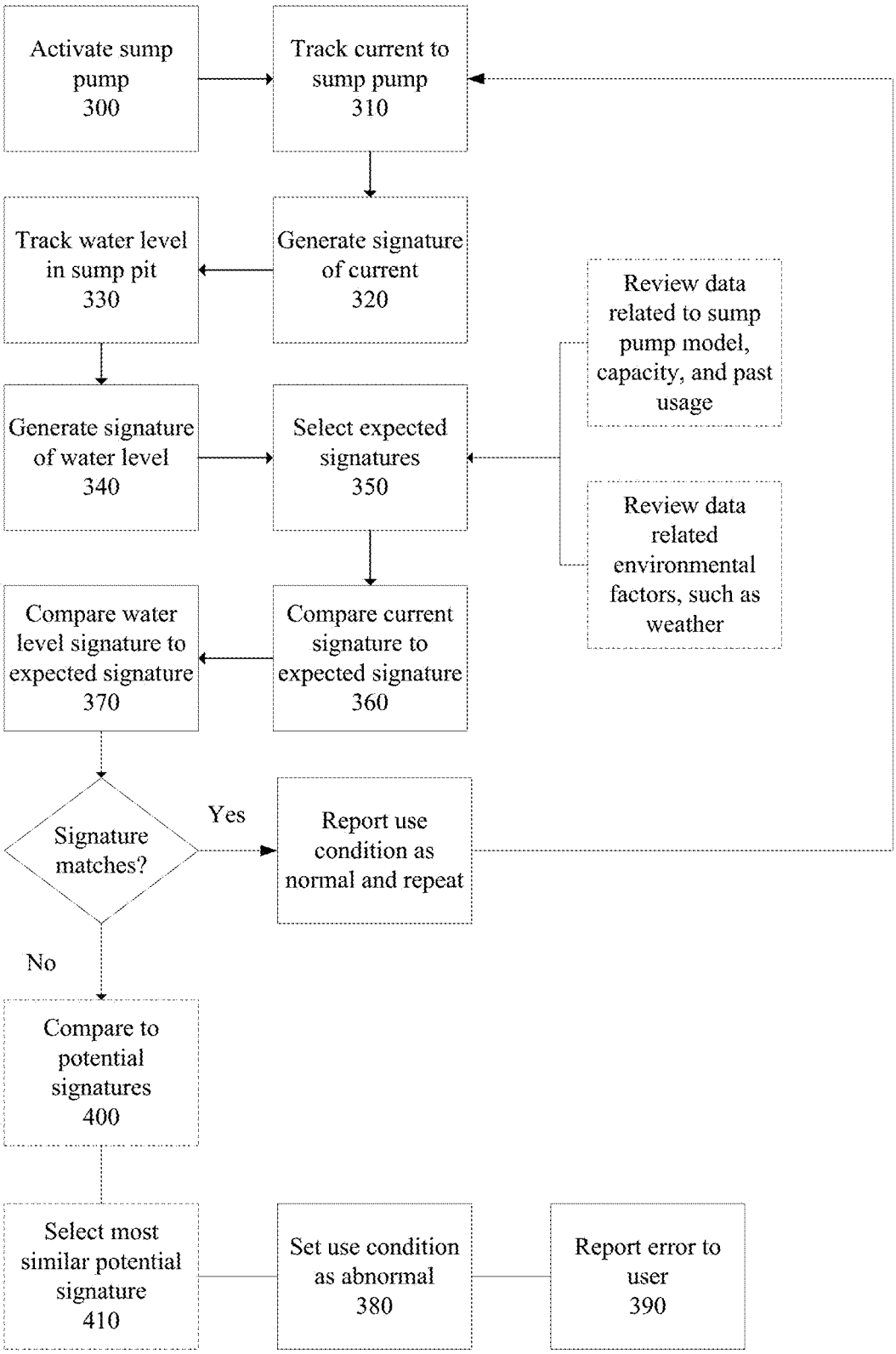
FIG. 2 is a flow chart illustrating a method for determining a use condition of the sump pump of FIG. 1.

FIG. 2 shows a method that may be implemented in the sump pump installation of FIG. 1. While the method is illustrated with respect to a particular sump pump installation, it will be understood that the method could also be applied to other sump pump installations, as well as other appliance installations.

The method typically begins when one of the primary sump pump 110 or backup sump pump 180 are activated (300). During operation, the method tracks (310) current flowing to the sump pump 110 (or backup sump pump 180) over time. The tracked information is then used to generate (320) an actual current signature for the sump pump 110 during operation. Throughout this application, the term "signature" is used to refer to a trace of a signal (of any characteristic of the appliance) over time. As such, the signature analysis of the current flowing to the sump pump may be evaluated to generate a plot of current over time in order to identify trends. Similarly, a parallel signature analysis may be applied to other characteristics, such as water level, described below, to generate a plot of that characteristic over time and identify trends.

The method simultaneously tracks (330) a water level in the sump pit 120 over time. The tracked information is then used to generate (340) an actual signature of the water level over time.

The method then selects (350) or retrieves an expected current signature and an expected water level signature for comparison to the current signature generated at 320 and the water level signature generated at 340. A variety of factors may be evaluated to determine an appropriate expected signature for each of the characteristics. For example, model details for the specific sump pump being monitored may be considered in selecting an expected signature so that the current usage for the particular sump pump can be compared to the expected current usage. Similarly, a rating for the sump pump may be considered to determine if the water level is consistent with the pump rate the particular sump pump is rated for. Since different models may behave differently, and may respond to rising water levels using different patterns, information related to the particular sump pump can clarify whether an actual signature for each characteristic is as expected. Further, the expected current signature may be selected based on historical trends recorded for the particular appliance being monitored. Historical results of the method being implemented may be recorded in a memory, and the historical average, or trend, may be used to determine an appropriate expected current signature for the appliance. For example, if a particular model sump pump is known to follow certain trends as it ages, such a pattern may be monitored and used to determine an expected current range.

The method may also monitor such usage trends, and identify them in the usage patterns being evaluated. Data for identifying such trends may be stored or may be transmitted to a centralized database so that data for particular models may be monitored across multiple users to identify recurring trends. Such data may also be tied to geographical locations for such models, and the data collected at such a database may be utilized to monitor usage trends for specific locations, as well as generate flood maps for those locations.

In addition to, or in place of, model information, current weather conditions, such as a current rate of rainfall, may be utilized to determine an appropriate water level or current signature. Weather data may be extracted from weather API services over the internet, and may potentially extract data from various online sources and other rain or pressure sensors. A pump that is running with a normal current signature for rainfall conditions may be considered to be malfunctioning if no rainfall is detected. For example, a broken check valve can be responsible for a sump pump that runs indefinitely with a healthy current signature if no local rainfall is detected. Alternatively, a stuck float valve can explain a running pump with a power signature that indicates that no water is being pumped. An interpretation of the signatures detected may contrast with appropriate interpretations of the same signatures where the system faces heavy rainfall conditions. Further, not all pumps can move sufficient amounts of water for all flooding conditions, and heavy rainfall may overwhelm the capacity of a pump. ⅓ horsepower pumps might be able to move 35 gallons of water per minute but a ½ horsepower pump can handle larger storms or surges with up to 60 gallon per minute throughput. As such, a water level may be expected to rise, or fall more slowly, during a rain storm, even when a sump pump is running properly.

While the method is described with respect to a current signature and a water level signature, and is applied to a sump pump, it will be understood that the current signature may be replaced with a signature of a different characteristic of the appliance. Typically, the first characteristic would be a rate for an input into the device. For example, the first signature may be a generic fuel rate, so that a gas powered pump can be evaluated based on its patterns of fuel consumption. Similarly, when applied to a different appliance, the method may consider different characteristics of the appliances.

The water level signature may also be replaced with a signature of a generic second characteristic depending on the appliance being evaluated. Typically, the second characteristic would be a rate related to an effect of the device. While a sump pump will regulate a water level in a sump pit, a different type of appliance may have a different effect. For example, when monitoring an oven, the first characteristic may be fuel supplied to the oven (either in the form of current or gas), and the second characteristic may be the internal temperature of the oven. In this way, the method may monitor for irregularities in both the fuel consumption and the effectiveness of the appliance, and may evaluate these factors for signs of impending failure prior to actual failure.

Accordingly, the expected signature for each characteristic may be selected based on an environmental effect. While weather conditions may assist in selecting an expected signature in the case of sump pumps, different environmental effects may be considered in the case of other appliances. For example, the contents of an oven may change an expected rate of preheating for any given model oven. In the case of the sump pump, the method may check news reports to determine if there is a local power outage that would cause the primary sump pump 110 to fail and the backup sump pump 180 to activate instead.

Returning now to the method, the method then compares (360) the first actual signature (the current signature, generated at step 320), to an expected signature for the same characteristic. Similarly, the method compares (370) the second actual signature, (the water level signature, generated at step 340), to an expected signature for the same characteristic.

If either signature does not match the corresponding expected signature, the method may immediately determine that the use condition of the sump pump is abnormal (380) and indicate an unexpected result. In such a case, the method may immediately report (390) an error to a user so that the user can investigate the sump pump.

Optionally, once the platform determines that the sump pump is operating abnormally, it may proceed to compare (400) the actual signature to a variety of other potential signatures, each representing a different abnormal status. An example of this comparison process is illustrated and discussed below with respect to FIGS. 3 and 4A-C. A similar process may be performed with respect to the water level signature. In some embodiments, each potential signature for the current signature may correspond to several potential signatures for the water level signature, and each combination may represent a different abnormal use condition. Several examples of these combinations are provided below in FIGS. 5A-6B.

The method then selects (410) a current use condition for the appliance based on the relationship between the actual current signature and the corresponding expected signature, as well as the relationship between current signature and the potential signatures representing abnormal statuses, as well as the relationship between the Actual water level signature and the corresponding expected or potential signatures.

While the method as described begins when the sump pump is activated, alternative versions of the platform may monitor an appliance constantly, and may trigger an alert if, for example, the first signature or the second signature are not as expected while the appliance is idle.

The comparison of the actual signatures to the corresponding expected signatures may be based on any number of criteria. For example, in the case of the actual current signature, the data collected may be evaluated to determine the duty cycle, pump frequency, and current draw, and may then be compared to the duty cycle, pump frequency, and current draw of the expected current signature. Similarly, the water level signature may be compared on the basis of patterns in the increasing or decreasing of the water level.

Further, the sump pump 110 may be activated when the switch 160 is not triggered as part of a maintenance cycle. This maintenance cycle may be monitored by the method in order to determine if the current signature is as expected during a standard maintenance cycle. Further, such a maintenance cycle may be triggered by the method in order to check the sump pump 110 status. The method may track these maintenance cycles and various use cycles over time, and may store results in memory. These results may be used to track long term trends, and may give the user a view of the overall health of the sump pump through its usage. Further software displaying the results may be able to present weekly or yearly historical activity, or compare current activity to corresponding time periods. It may also be able to overlay local weather events onto the data.

Similarly, long term trends may be used to illustrate cumulative performance and monitor flow rate and duty cycle history. The method may also be used to trigger testing of both the primary sump pump 110 and the secondary sump pump 180 and perform preventative maintenance.

A maintenance cycle incorporated into the method may further test the backup sump pump 180 associated with the installation by powering off the main sump pump for a period of time so that the backup sump pump may be activated. Further, the method may monitor an independent measure of water level to determine if the switches for the sump pumps installed are activating at the appropriate water level.

Figure 3:
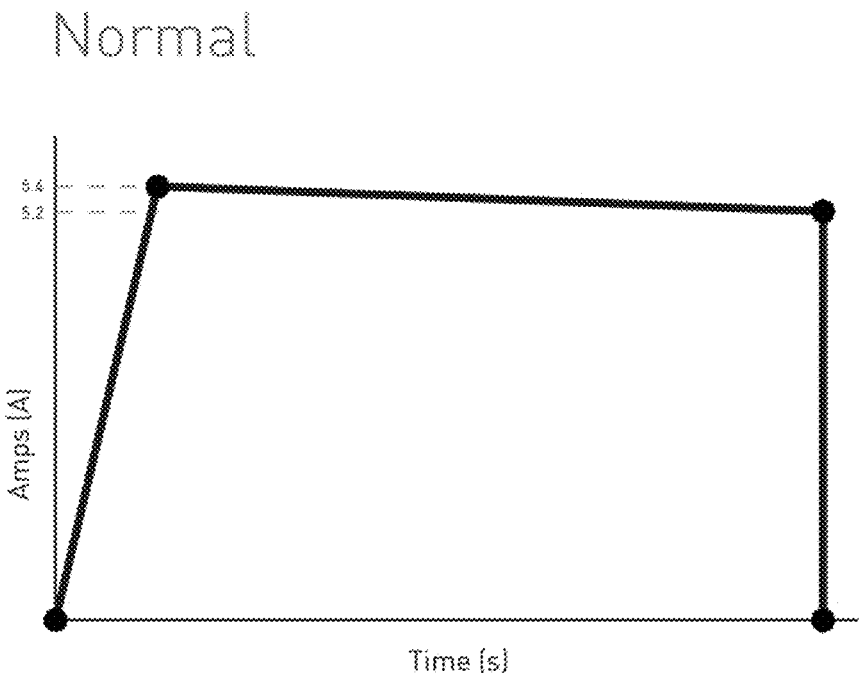
FIG. 3 illustrates a normal current signature for a sump pump installation.
Figure 4A:
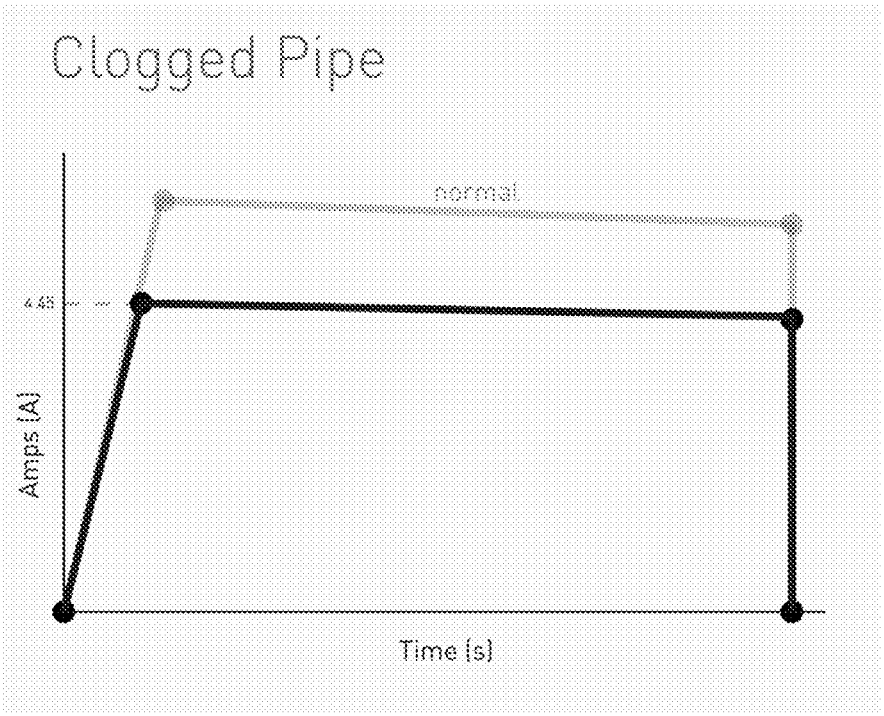
FIGS. 4A-C illustrate comparisons between the normal current signature shown in FIG. 3 and current signatures illustrating various use conditions.
Figure 4B:
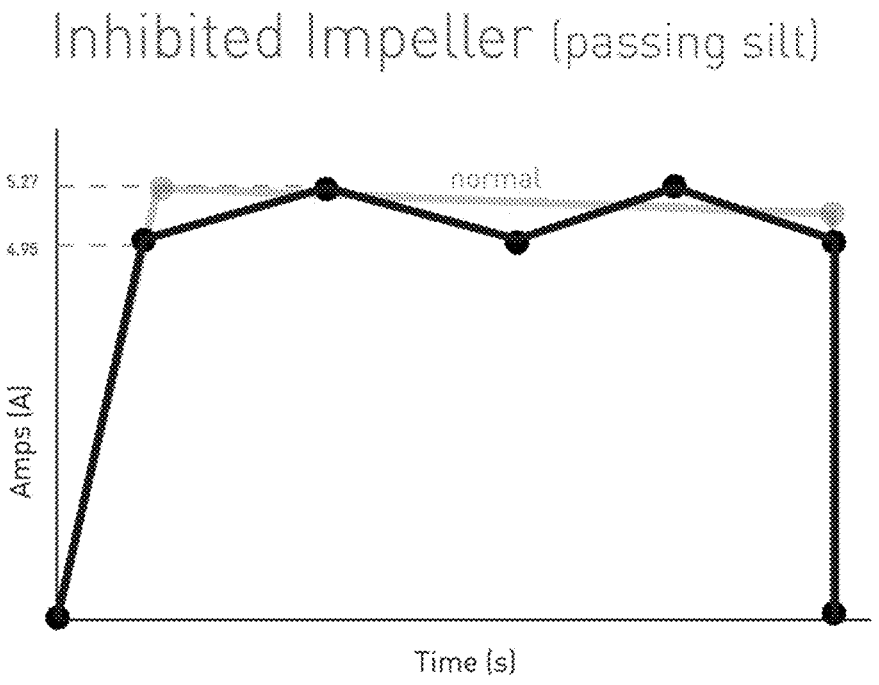
Figure 4C:
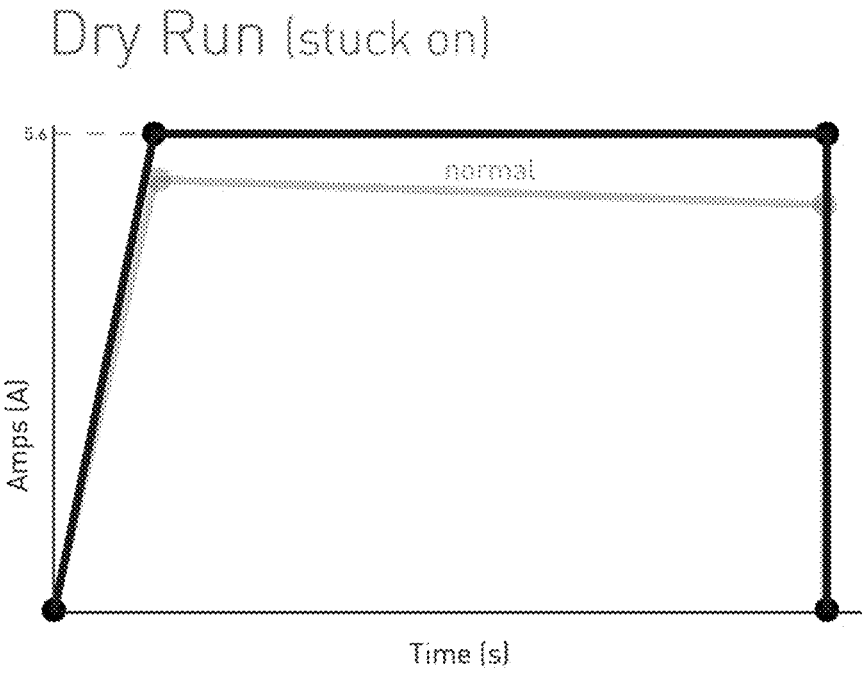

FIG. 3 shows a normal current signature for a sump pump during operation, and FIGS. 4A-C show several potential signatures representing different failure modes. The plot shown in FIG. 3, labeled "Normal," represents normal operation of the sump pump, and so long as the actual current signature is substantially similar to the current signature shown in the plot, the current use condition of the sump pump will indicate normal operation.

If the actual current signature does not indicate normal operation, the actual current signature may be compared to each of the three alternative signatures shown in FIGS. 4A-C. If the actual current signature is substantially similar to any of those alternatives shown, the current use condition of the sump pump will be set to represent either a clogged pipe, an inhibited impeller, or a dry run respectively. When a specific failure mode is selected as the current use condition, the method may suggest ways to address the particular failure mode, or may initiate a shutdown of the primary sump pump 110 or some other automated resolution to the failure mode. Alternatively, the method may simply alert the user to the use condition.

FIGS. 5A-B show a failure mode analysis for the primary pump 110 and FIGS. 6A-B show a failure mode analysis for the backup pump 180. In the description of the device features provided, which typically outline ways in which the method can detect specified failure modes, different characteristics are described as monitored, including current and water level, as described above, as well as pressure at various points in the system, temperature, flow rates—table of failure conditions (and analysis). A similar evaluation is provided with respect to the backup sump pump 180.

While variations of the method described may be used to monitor different factors referenced in the figures, the method described with respect to FIG. 2 relies on two characteristics, current flow and water level, to generate appropriate signatures for comparison. This is because those factors may be used as proxies for many of the factors discussed in the FMEA analysis. For example, if an impeller is obstructed, the obstruction may be identified based on the exit flow rate, as shown in the FMEA in FIG. 4A. However, a unique current signature may be used as a proxy to determine that the impeller is obstructed, mitigating the need to physically monitor the exit flow rate.

FIG. 7 shows a table of use conditions or components that may be failing and correlates them with indications of those use conditions or components. The table further indicates factors that may be used to determine that a sump pump may be in the corresponding use condition based only on observable aspects of current signatures, water level signatures, and in some cases, environmental factors, used to contextualize those signatures.

FIG. 8 shows measurements of current flow that could be used along with corresponding current signatures, to identify certain failure modes without additional information. While the method described monitors current signature and water level signature, variations of the platform may monitor only a single factor. For example, the current signature alone may give large amounts of useful information, as shown in the figure. Short, jumps in current may indicate the presence of silty or muddy water. Higher than normal current may indicate a pump running while dry, which can in turn indicate a stuck float valve water sensor. Short cycling, in which a motor runs and then shuts off only to run again immediately after shutting off, can indicate a malfunctioning check valve. In some embodiments, the make and model of the sump pump being monitored may be detected based on the normal operating current signature, obviating the need for a user to enter the information manually in a platform interface.

Figure 9:
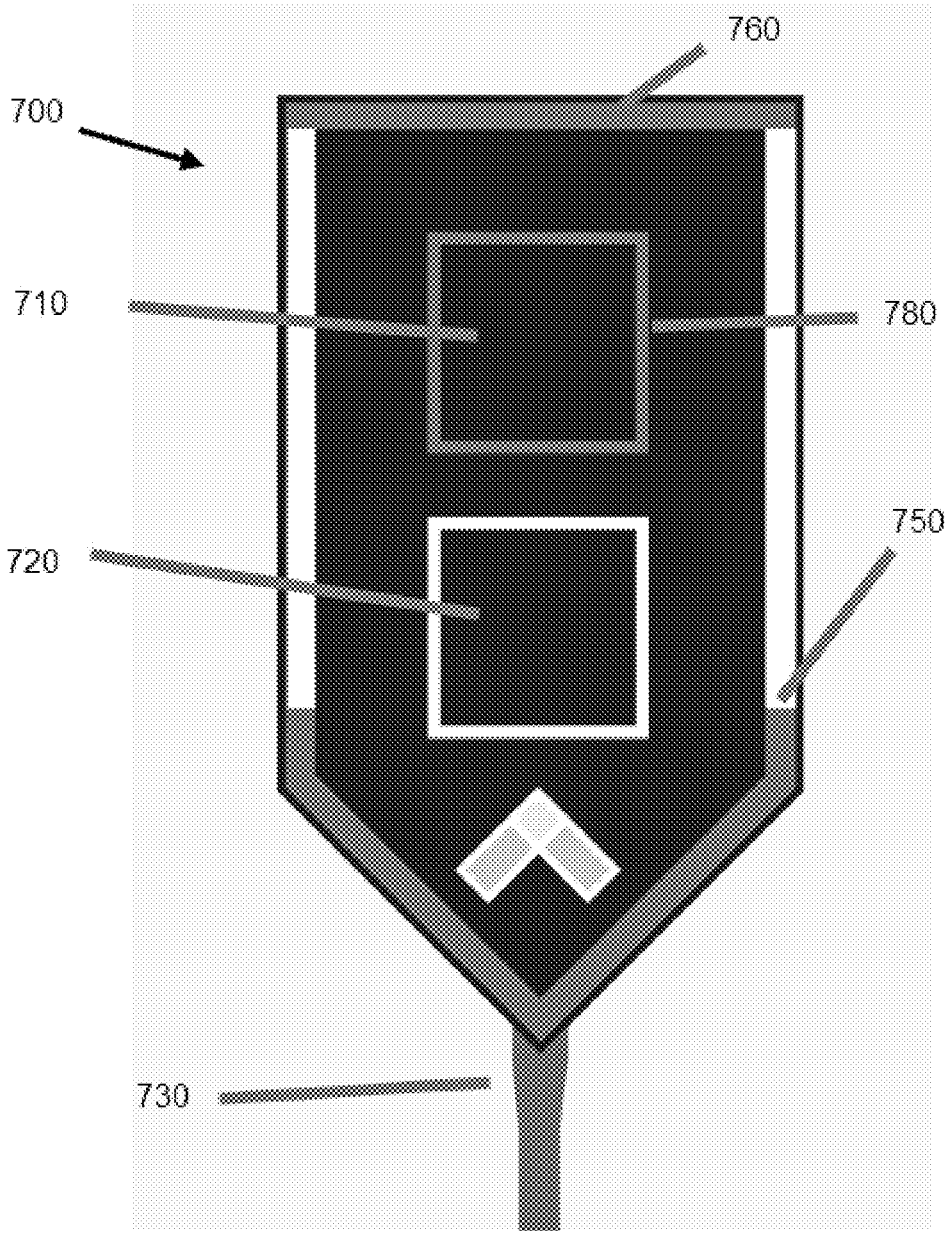
FIG. 9 shows a device used as part of a system for implementing the method of FIG. 2.
Figure 10:
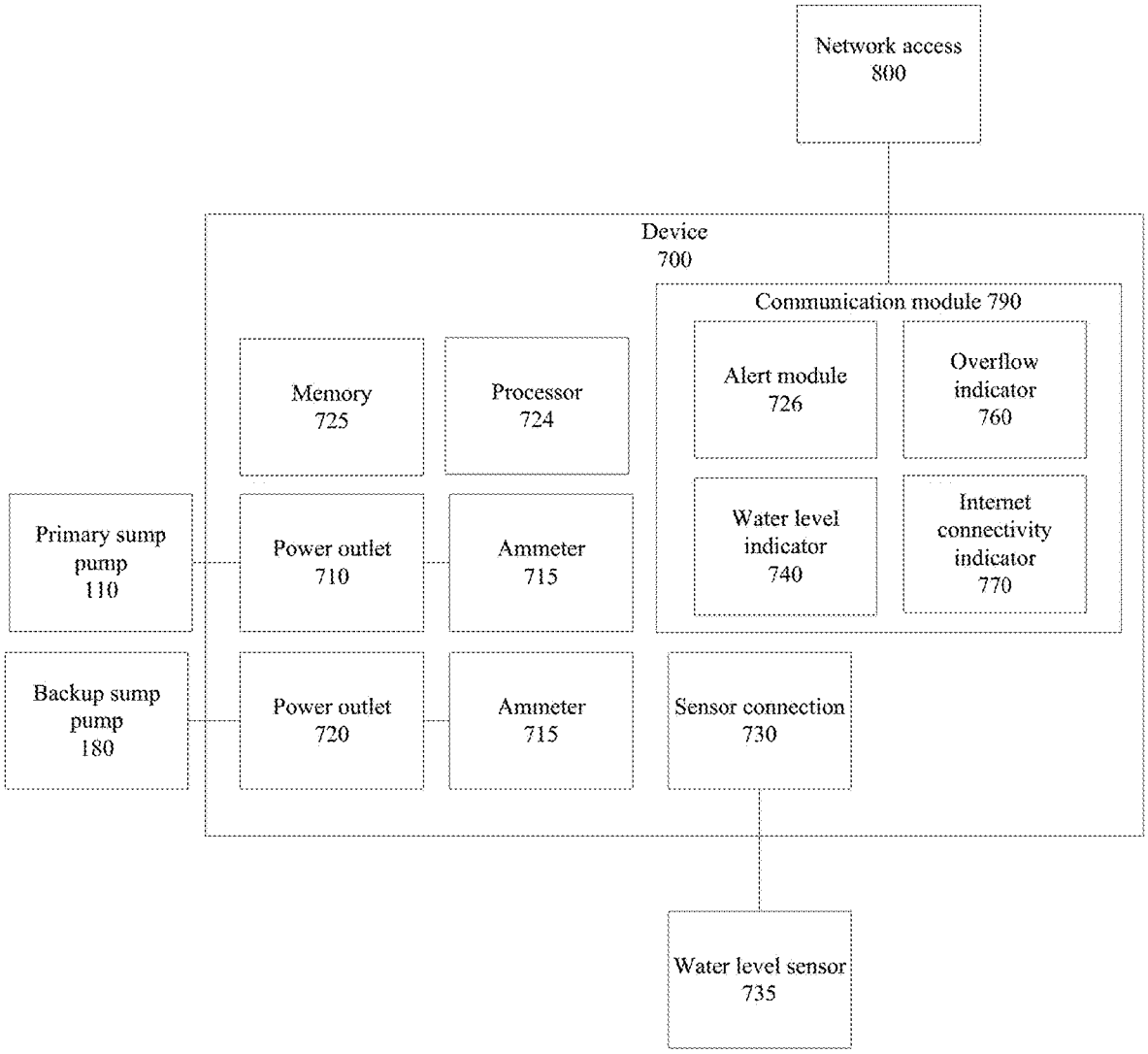
FIG. 10 shows a schematic representation of the device of FIG. 9.

FIG. 9 shows a device 700 that may be used as part of a system for implementing the method of FIG. 2 and FIG. 10 shows a schematic representation of the device 700 in the context of such a system. As shown, the device is typically in the form of a power source 700, and contains a first pass through power outlet 710 for a primary sump pump 110 and a second pass through power outlet 720 for secondary sump pump 180. Each power outlet 710, 720 may include, or may be connected to, ammeters 715, or other circuits for measuring current flowing to the corresponding sump pump 110, 180. The power source 700 may further contain a memory 722, for storing information related to characteristics tracked by the methods implemented therein, a processor 724 for generating and comparing signatures of the characteristics tracked, and an alert module 726 for alerting a user as to a use condition of each of the sump pumps in the event of an emergency.

Typically, the power source 700 may further comprise a connection 730 for connecting a water level sensor 735, such as a solid state liquid level sensor strip with continuous water sensors, a capacitive water level sensor, an infrared rangefinder, or an ultrasonic rangefinder. The power source may further contain a display or other indicators. In the embodiment shown, the power source contains several indicators, including a water level indicator 740 that displays a height 750 representing the depth of water within the sump pit 120. The water level indicator 740 may change color as the water level goes up, and may flash red, for example, when the sump pit fills up. There may be an independent overflow indicator 760 that flashes when the water level gets too high. The power source 700 may further contain an icon 770 that flashes to indicate internet connectivity. Similarly, indicators 780 surrounding the power outlets 710, 720 may flash to indicate the health of connected pumps.

Because the power source 700 monitors water level independently of the switches 140 on the sump pumps 110, 180, the method can determine if the sump pumps should be activating but are not.

Further, the power source 700 may contain a communication module 790 that provides internet or other network access connectivity 800, and may receive information from the internet, such as weather reports and local power failure information. The communication module may further allow for the device 700 to output a use condition and maintain connectivity with a user. The power source 700 may also contain a wireless connection to a traditional phone-line for communication in the event of a power failure. This connection may be in the form of a Bluetooth wireless link to a low power phone line dongle. Further, the power source may connect to sensor arrays for detecting local weather conditions and/or barometric readings. In some embodiments, the power source 700 may further transmit operation information to a central repository or database that can be used to compiled information about sump pumps and failure modes. For example, such a database may then be used to identify high and low performing sump pumps.

In order to install the power source 700, a user may simply plug the sump pump into the power source. In some embodiments, the power source may be paired with software for a smart phone, using the communication module 790, which may then be used to calibrate the system. For example, the user may input information about the specific sump pump used, the sump pit diameter and height, dimensions of the discharge pipe, the age of the pump, and other details.

The power source 700 may further incorporate a ground fault circuit interrupter, or other type of circuit breaker in order to protect the sump pump 110 and the home power system in the event of a detected failure. Additional sensors and detectors may be included as well, such as moisture detectors for detecting moisture outside the sump pit 120, humidity detectors, mold detectors, and radon detectors.

While a power source 700 designed to be placed directly on top of a power outlet is shown, the method may also be performed using an independent box that plugs into the wall and has outlets available for plugging in the sump pumps 110, 180. In such an embodiment, the box may be located in between the secondary backup sump pump 180 and its associated battery so that it may detect battery health and the functioning of the sump pump when utilizing battery power.

Further, the device 700 may output information related to the status of the sump pumps 110, 180 connected thereto via the communication module 790, and such information may be sent directly to a user, or to a central monitoring station. The device 700 may do this by connecting to a phone line, a cell phone or other wide area network, or to a user's home network using Wi-Fi or other wired or wireless technologies. The alert module 726 may communicate using the communication module 790, or it may use a backup communication technology to provide emergency alerts related to a use condition of the device 700. In some embodiments, such as that shown in FIG. 10, the alert module 726, as well as other indicators incorporated into the device may be incorporated into the communication module 790.

In an embodiment of the present invention, some or all of the method components are implemented as a computer executable code. Such a computer executable code contains a plurality of computer instructions that when performed in a predefined order result with the execution of the tasks disclosed herein. Such computer executable code may be available as source code or in object code, and may be further comprised as part of, for example, a portable memory device or downloaded from the Internet, or embodied on a program storage unit or computer readable medium. The principles of the present invention may be implemented as a combination of hardware and software and because some of the constituent system components and methods depicted in the accompanying drawings may be implemented in software, the actual connections between the system components or the process function blocks may differ depending upon the manner in which the present invention is programmed.

The computer executable code may be uploaded to, and executed by, a machine comprising any suitable architecture. Preferably, the machine is implemented on a computer platform having hardware such as one or more central processing units ("CPU"), a random access memory ("RAM"), and input/output interfaces. The computer platform may also include an operating system and microinstruction code. The various processes and functions described herein may be either part of the microinstruction code or part of the application program, or any combination thereof, which may be executed by a CPU, whether or not such computer or processor is explicitly shown. In addition, various other peripheral units may be connected to the computer platform such as an additional data storage unit and a printing unit.

The functions of the various elements shown in the figures may be provided through the use of dedicated hardware as well as hardware capable of executing appropriate software. When provided by a processor, the functions may be provided by a single dedicated processor, by a single shared processor, or by a plurality of individual processors, some of which may be shared. Explicit use of the term "processor" or "controller" should not be construed to refer exclusively to hardware capable of executing software, and may implicitly include, without limitation, digital signal processor hardware, ROM, RAM, and non-volatile storage.

Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

All examples and conditional language recited herein are intended for pedagogical purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A method for determining a use condition of a sump pump comprising:

receiving an indication of a weather condition at a location of the sump pump during a time period, the indication of the weather condition not being derived from activity of the sump pump;

selecting an expected first signature for a first characteristic associated with the sump pump and an expected second signature for a second characteristic associated with the sump pump, wherein at least one of the expected first signature and the expected second signature is selected from a plurality of potential corresponding expected signatures based on the weather condition indicated, and wherein each of the first signature and the second signature represent a trace of a corresponding physical characteristic of the sump pump over time;

generating an actual first signature of the first characteristic by recording a trace of the first characteristic over time for the time period;

generating an actual second signature of the second characteristic by recording a trace of the second characteristic over time for the time period;

comparing the actual first signature to the expected first signature;

comparing the actual second signature to the expected second signature;

selecting a current use condition from a plurality of use conditions based on the relationship between the actual first signature and the expected first signature as well as the relationship between the actual second signature and the expected second signature; and indicating that the sump pump is in the current use condition.

2. The method of claim 1 wherein the current use condition indicates abnormal operation if the actual first signature is not substantially similar to the expected first signature or the actual second signature is not substantially similar to the expected second signature.

3. The method of claim 2 wherein if the current use condition indicates abnormal operation, the actual first signature is further compared to a plurality of additional expected first signatures representing different failure modes, and the current use condition is selected to correspond to the expected first signature most similar to the actual first signature.

4. The method of claim 1 wherein the first characteristic is a record of fuel supplied to the sump pump over time and the second characteristic is a record of an effect of the functioning of the sump pump over time.

5. The method of claim 4 wherein the first characteristic is a current and the actual first signature is a current signature and the method further comprises using the actual first signature to determine at least one of duty cycle, frequency, or current draw, and comparing the determined value to an expected duty cycle, frequency, or current draw.

6. The method of claim 4 wherein the second characteristic is a water level associated with the sump pump.

7. The method of claim 1 further comprising selecting an expected first signature or an expected second signature based on product information from the sump pump.

8. The method of claim 1 wherein an expected first signature is a previously generated actual first signature or an expected second signature is a previously generated actual second signature for the sump pump.

9. The method of claim 1 wherein the plurality of use conditions includes a normal condition, a failure condition, and a projected failure condition.

10. The method of claim 9 wherein the projected failure condition includes a projected failure time.

11. The method of claim 1 further comprising determining if a power supply has failed, and wherein the actual first signature is from the sump pump if the power supply has not failed and wherein the actual first signature is from a secondary backup sump pump if the power supply has failed, and wherein the expected first signature and the expected second signature are based on the secondary backup sump pump.

12. The method of claim 1 further comprising storing a record of the actual first signature and the actual second signature and evaluating average values over multiple use cycles.

13. The method of claim 12 further comprising transmitting the actual first signature and the actual second signature to a database, and wherein data from a plurality of sump pumps is compiled at the database and evaluated at a server.

14. The method of claim 13 further comprising transmitting a geographical location of the sump pump to the database such that the actual first signature and the actual second signature are stored with a corresponding geographical location.

15. A system for determining a use condition of a sump pump, the system comprising:

an electrical outlet for providing an electric current to a sump pump;

a current measuring circuit for determining the current supplied to the sump pump;

a memory;

a processor;

an alert module;

a weather data module for receiving an indication of local weather conditions at a location of the sump pump, the weather conditions not being derived from activity of the sump pump, and a water level detection module; and wherein the processor selects an expected current signature associated with the sump pump and an expected water level signature first signature associated with the sump pump, wherein at least one of the expected current signature and the expected water level signature is selected from a plurality of potential corresponding expected signatures based on the indication of local weather condition at the location of the sump pump during a time period, and wherein each of the expected current signature and the expected water level signature represent a trace of a corresponding physical characteristic of the sump pump over time;

wherein the memory records the current supplied to the sump pump over time and wherein the processor generates an actual current signature from the current supplied to the sump pump over the time period; and wherein the processor compares the actual current signature to an expected current signature over the same time period, and wherein the memory records an actual water level over time, and wherein the processor generates an actual water level signature from the water level detected over time, and wherein the processor compares the actual water level signature to an expected water level signature over the same time period;

wherein the alert module transmits an alert indicating a use condition if the actual current signature is not substantially similar to the expected current signature or if actual water level signature is not substantially similar to the expected water level signature.

16. The system of claim 15 wherein the electrical outlet, current measuring circuit, memory, and processor are located within a housing, and wherein the housing further comprises a plug for plugging the housing into a wall outlet and the housing forms a pass-through power outlet.

* * * * *